United States Patent [19]

Bronnec

[11] 4,294,698

[45] Oct. 13, 1981

[54] DEVICE FOR CLEANING LIQUID SURFACES

[75] Inventor: Jean A. L. Bronnec, Brest, France

[73] Assignee: Etablissements Generaux de Mecanique de l'Ouest, Brest, France

[21] Appl. No.: 97,724

[22] Filed: Nov. 26, 1979

[30] Foreign Application Priority Data

Apr. 12, 1981 [FR] France ..... 78 34077

[51] Int. Cl.[3] ..... E02B 15/04

[52] U.S. Cl. ..... 210/242.3; 210/923

[58] Field of Search ..... 210/83, 242, DIG. 25, 210/923

[56] References Cited

U.S. PATENT DOCUMENTS

| | | | |
|---|---|---|---|
| 3,557,960 | 1/1971 | Fitzgerald | 210/242 |
| 3,612,280 | 10/1971 | Fitzgerald | 210/242 |
| 3,618,768 | 11/1971 | Brown | 210/83 |
| 3,653,510 | 4/1972 | Fitzgerald | 210/83 |
| 3,656,624 | 4/1972 | Walton | 210/DIG. 25 |
| 3,662,891 | 5/1972 | Headrick | 210/242 |
| 3,730,346 | 5/1973 | Prewitt | 210/242 |
| 3,771,662 | 11/1973 | Muramatsu | 210/DIG. 25 |

FOREIGN PATENT DOCUMENTS

| | | | |
|---|---|---|---|
| 1528855 | 6/1968 | France | 210/DIG. 25 |
| 2174454 | 12/1973 | France | 210/DIG. 25 |

*Primary Examiner*—Theodore A. Granger

*Attorney, Agent, or Firm*—Sandler & Greenblum

[57] ABSTRACT

A device for cleaning liquid surfaces to remove a pollutant therefrom. The device comprises a barrier adapted to float on the surface of the liquid. The barrier comprises two diverging wing portions. Inlet means are provided and are adapted to receive the polluted material prior to passing the polluted material to a recovery apparatus. The device further comprises only hitching means adapted to maintain each of the wings spaced from one another at one of their ends while the barrier is being towed. Each of the wing portions of the barrier comprises a wing rope adapted to at least partially float on the liquid surface. The barrier further comprises a tow rope arranged between each of the wing ropes which is adapted to pull the recovery apparatus thereby exerting a tension on each of the wing ropes while maintaining each of the wing ropes such that they do not substantially curve in the horizontal plane relative to the surface while nevertheless allowing for movement of the wing ropes in a vertical plane with respect to the surface.

16 Claims, 4 Drawing Figures

10
11a
11b
12
13a
13b
14
15
16a
16b
17
18a
18b
19
20
21
22
23a
23b
24
25
26
27
28
30
F
f
f'

DEVICE FOR CLEANING LIQUID SURFACES

BACKGROUND OF THE INVENTION

1. Field of the Invention

The invention relates to the recovery of floating materials and more particularly to pollutants floating on the surface of water.

2. Description of Prior Art

The surfaces of bodies of water such as rivers, tributaries, seas and oceans are subject to normal or accidental wastes which burden them with diverse floating solid or liquid wastes. Some wastes may assume outrageous proportions such as, for example, the "black tides" of hydrocarbons which may result from oil spills.

Various recovery apparatus for floating materials utilizing diverse means for receiving the materials on the planar surface of the water are known. Devices utilizing suction, bucket conveyers, shovel pumps, etc. have been proposed. The devices have a slightly submerged inlet which is followed by an elevator bringing the materials received to an evacuation channel which directs them into a decantation and storage container. Very often the apparatus is mounted on a barge which itself carries a decantation container.

To obtain a sufficiently efficient operation it is necessary to concentrate, i.e., to collect the wastes in the form of a sheet, and to move this sheet relative to the inlet of the apparatus. This relative movement which is necessary for the increase of the yield in every case is quite clearly indispensable when the inlet of the apparatus is a simple pocket, more or less flexible, connected by a flexible pipe to a pump means, since to fill the pocket the pocket must be subjected to a veritable "trawling" operation.

When the sheet of floating materials initially has a sufficient thickness and when one is operating in relatively calm water and at a small distance from the bank, the relative movement of the sheet towards the opening can be achieved with a device having long jointed vanes, such as described and claimed in French Patent No. 78 19,943 in the name of the instant Applicant.

In other instances, e.g., very thin pollutant layers and/or agitated surface and/or necessity to operate at a significant distance from the shore, it has been proposed to "sweep" the surface of the water by utilizing a "floating barrier" drawn by its two ends and whose central portion comprises the inlet or opening of the recovery apparatus. The recovery apparatus itself is floated, i.e., it may be mounted on a barge and moves together with the barrier either under its own power when the link to the inlet is flexible or by being pulled more or less freely when this link is rigid.

The barrier assembly can be pulled by pulling means on the shore or by towing the two ends of the barrier. The two ends may be towed separately or together.

However these "sweeping" devices have proven themselves only barely efficient and of very limited use by virtue of the very structure of the floating barriers used.

Until now, in known floating barriers, each of the wings is constituted by the linkage, in a line, of light hollow elements having thin inflatable or rigid walls. These walls are made out of plasticized or rubberized sheets, plastic cloth material, or out of metal.

By using such materials, the barrier has a very substantial transverse surface area thus resulting in a very substantial hydrodynamic resistance to any current moving relative thereto. Consequently, very substantial traction forces are necessary. Furthermore, known devices are very subject to wind forces with respect to the visible or non-submerged potion of the device. If materials having a small thickness are used for the walls, this results in a barrier having only a weak resistance to forces and other shocks thus resulting in the possibility of rupture.

The oblong shape of known elements prevents them from adapting themselves to the irregularities of an agitated surface (waves or splashes) and results in the assembly being very cumbersome which, in turn, does not simplify transportation of the barrier and necessitates long and costly preparations for placing the device in service.

Finally, such a drawn barrier assumes, by virtue of the hydrodynamic resistance, a general shape approximating a U-shaped curve known in French as a "chainette", i.e., having the shape of a pocket having a flattened end resulting in a poor concentration of the floating materials.

SUMMARY OF THE INVENTION

It is, therefore, an object of the invention to provide a means for cleaning the surface of a liquid which is effective yet simple.

These and other objects of the invention are fulfilled by means of the device of the invention for cleaning a liquid surface to remove a pollutant therefrom. The device comprises a barrier adapted to float on the surface of the liquid. The barrier comprises two diverging wing portions. Inlet means are provided and are adapted to receive the polluted material prior to passing the polluted material to a recovery apparatus. The device further comprises hitching means adapted to maintain each of the wings spaced from one another at one of their ends while the barrier is being towed. Each of the wing portions of the barrier comprises only a wing rope adapted to at least partially float on the liquid surface. The barrier further comprises a tow rope arranged between each of the wings which is adapted to pull the recovery apparatus thereby exerting a tension on each of the wing ropes while maintaining each of the wing ropes such that they do not substantially curve in the horizontal plane relative to the surface while nevertheless allowing for movement of the wing ropes in a vertical plane with respect to the surface.

The inlet means itself may be mounted on a floating element.

The hitching means may be mounted on a towing means so as to extend transversely to the axis along which the barrier is being towed. The hitching means comprises one outer attachment point at both ends of the hitching means whereat each of the ropes is connected to the means, and an inner attachment point between each of the outer attachment points. The tow rope is attached to the inner attachment point. The wing ropes used exhibit high tension resistance. The angle separating each of the wing ropes is less than about 30 degrees.

The hitching means itself may comprise a tubular whiffletree having a triangular configuration. The whiffletree comprises two outwardly extending arms each comprising a float on the outer end thereof. The whiffletree itself is triangular and comprises an apex so that the whiffletree is journalled on a tugboat around a vertical axis. Each of the arms of the whiffletree is pivotable around a horizontal hinge whereby each of the arms may be raised and lowered in the vertical direction. Means for raising each of said the arms when not in use to facilitate manouver of the tug may also be provided.

Supplemental ropes may optionally be arranged between each of the wing ropes and the tow rope, each of the supplemental ropes extending from a forward point along one of the wing ropes to a rearward point on the tow rope, with the forward and rearward points being defined with respect to the direction of movement of the barrier. Each of the supplemental ropes may have a cross section substantially equal to that of the wing ropes along most of its length while the cross section of the supplemental rope adjacent to the tow rope is less than the cross section over the rest of its length. The cross section of each of the wing ropes and each of the supplemental ropes increases in the direction from the hitching means to the inlet means so as to minimize leakage of the polluted material by virtue of the increasing thickness of the layer of polluted material formed.

BRIEF DESCRIPTION OF THE DRAWINGS

The invention will be better understood with respect to the annexed drawings which represent one non-limiting embodiment in which.

DESCRIPTION OF PREFERRED EMBODIMENTS

Figures 1, 2, 3, 4:
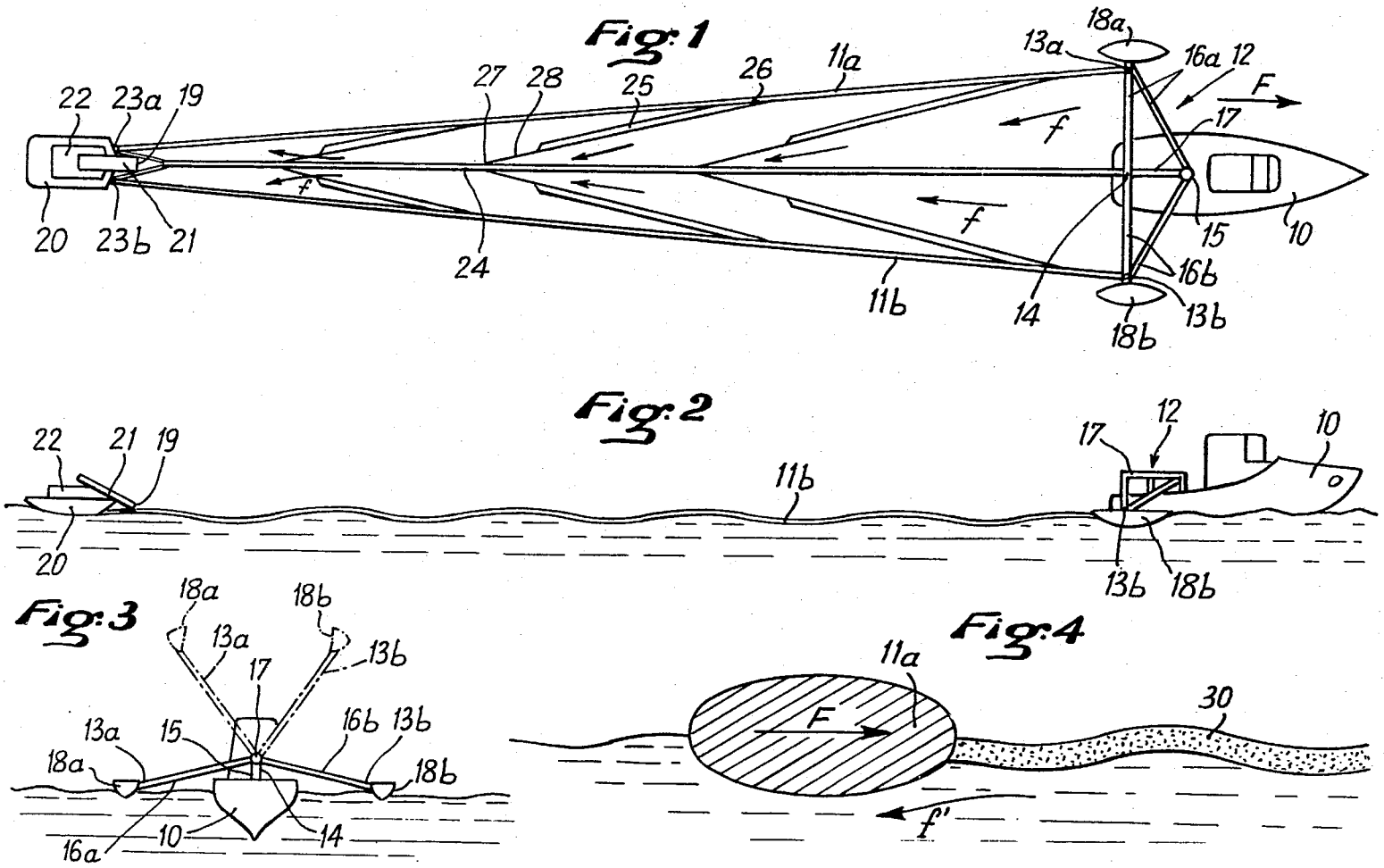
FIG. 1 is a planar schematic view on a reduced scale, of a cleaning device of the invention in use.
FIG. 2 is an elevational schematic view, on a reduced scale, of a cleaning device according to the invention, in use, corresponding to FIG. 1.
FIG. 3 is a rear schematic view of the towing device of FIGS. 1 and 2.
FIG. 4 illustrates, on a very magnified scale, the cross section of a supplemental rope of a floating barrier along a plane parallel to the longitudinal plane of symmetry of the towing device.

The invention provides a cleaning device for liquid surfaces comprising a floating barrier for sweeping up a sheet of floating materials and directing it, while concentrating it, towards the inlet of a recovery apparatus. When using the device of the invention, there is only a slight water current present and the device is only slightly subject to wind current. Furthermore, a very high mechanical resistance to traction is present while the device nevertheless exhibits great flexibility with a minimum of cumbersomeness during transportation while, nevertheless, being able to be simply and rapidly set up.

The device according to the invention comprises a recovery apparatus for floating materials in which at least the inlet is mounted on a floating element. The apparatus further comprises a floating barrier comprising two wings which diverge from the sides of the opening of the apparatus and whose opposite ends are pulled by a towing assembly formed by at least one towing means.

It should be noted that the tractor assembly carries a linking means which extends transversely with respect to the towing axis and which is provided with three points of attachment. One point of attachment is at its middle for a tow rope tied down at its end opposite from the floating element carrying the recovery apparatus as well as another point of attachment at each of its ends. The points of attachment are placed as close as possible to the surface of the water, for tying the end of the corresponding wing of the floating barrier. Each of the wings comprises a floating wing rope of good tension resistance whose tension is adjustable in a manner so as to permit, when the tow rope is tautened to the maximum, a flexibility sufficient to substantially follow the vertical movement of the liquid surface without permitting the formation of an excessively pronounced curve in the horizontal plane.

As may be seen from the drawings, the device for cleaning the surface of a liquid comprises a towing assembly. In this instance, the assembly comprises by a tugboat 10, which pulls a floating barrier comprising two wings 11*a* and 11*b* which converge towards the rear relative to the direction of movement. As was noted above, the tractor assembly may, for example, comprise two separate towing means. These means may be land vehicles when the cleanup operation occurs along an area adjacent to the bank. Whatever the device used, the towing assembly is provided with a single hitching or linking means 12 provided with three attachment points, i.e., outer points 13*a* and 13*b* at each of its ends and an inner or central attachment point 14. This hitching means 12 extends transversely with respect to the towing axis F. Preferably, the hitching means is formed out of a tubular whiffletree having a triangular structure journalled at its apex around a vertical axis 15 provided on the tug 10.

The points of attachment 13*a* and 13*b* are adapted to respectively receive the ends of wings 11*a* and 11*b* of the floating barrier and must also be as close as possible to the planer surface of the water. To accomplish this, in a preferred embodiment of the invention, the arms 16*a* and 16*b* of the whiffletree are free to pivot and be deflected around a horizontal hinge 17 and each of the arms comprises at its free end a float 18*a* and 18*b* respectively which are preferably streamlined. The attachment points 13*a* and 13*b* need only be arranged immediately adjacent to the corresponding float. This arrangement further makes it possible, when the device is not in use, to fold the arms upwardly as shown in dashed lines in FIG. 3 so as to simplify the maneuvering of the tug 10.

Each of the wings of 11*a* and 11*b* of the floating barrier preferably is constituted of a rope or cord which floats on the liquid surface and which exhibits a high resistance to traction. The rope is preferably made out of synthetic fibers such as polyamides or polypropylene. The density of these fibers and the braiding results in the fact that these cables, of a known type, necessarily float while at least half submerged with respect to their height if not slightly more.

At their ends opposite to the whiffletree the ropes 11*a* and 11*b* are fastened to a floating element 20 which comprises at least one inlet opening 19 of a floating material recovery apparatus 21. The points of attachment 23*a* and 23*b* are situated on both sides of the opening. In the example shown the floating element 20 is a barge which carries the recovery apparatus 21 entirely and, furthermore, in a known fashion a decantation container 22 is also included. However, the floating element might also comprise a simple pocket connected by a flexible pipe to a pumping means. Finally, the floating element 20 is connected to the central attachment point 14 of the whiffletree 12 by a tow rope 24. This floating element 20 generally results in a sufficient resistance to the relative movement of the tug such that the rope 24 is constantly taut. However, if currents which many occur act to push the element 20 towards the tug 10 to slacken the rope 24, the element 20 must be provided with a motor whose rear propeller assures the tautness of rope 24.

The attachment points 23*a* and 23*b* of the cables 11*a* and 11*b* on the floating element are closer one to the other than the attachment points 13*a* and 13*b* of the cables on the whiffletree 12. Furthermore, the relative lengths of the rope 24 and of ropes 11*a* and 11*b* are such that when the rope 24 is held taut ropes 11*a* and 11*b* are substantially rectilinear and have just enough flexibility necessary to follow the vertical movements of the liquid surface (see FIG. 2) without assuming a curvature in the horizontal plane. As seen from above (FIG. 1) the floating barrier assembly generally has a arrowhead shape directed towards the rear.

Preferably, the relative values of the length of the rope 24 and the span of the whiffletree 12 are such that the angle formed by the two wings 11*a* and 11*b* is small, preferably smaller than 30 degrees, and most preferably on the order of 10 to 20 degrees. For example, the span of the whiffletree may be approximately 30 meters and the length of the rope may be approximately 150 meters.

Although it is not necessary, the floating barrier may advantageously further comprise a plurality of floating supplemental ropes 25. These ropes are arranged in a fishbone configuration. Each rope 25 connects a respective point 26 of one of the barrier wings to a point 27, arranged further back, on the tow rope 24 and has a cross section similar to that of the wings but ends in a portion 28 which is very thin adjacent to its attachment on the rope 24.

Finally, it is preferable to provide the floating barrier elements, i.e., the wings 11*a* and 11*b* of possible supplemental ropes 25, with a cross section which slightly increases in a continuous fashion when going from the front to the rear so as to avoid leaks of material due to the thickness of the sheet.

The operation of the device will now be described.

The tug 10 moves along the water whose surface is polluted. The floating pollution, for example a sheet 30 of a hydrocarbonaceous material such as oil or some other material (FIG. 4), passes under the arms 16*a* and 16*b* of the whiffletree 12 along the tug and encounters wings 11*a* and 11*b* of the floating barrier and, when they are used the supplemental ropes 25. At each encounter, the sheet (or the layer of diverse waste) is directed as shown by the arrows f in FIG. 1. This avoids accummulating and thickening the waste to the extent that it passes above or below the ropes by virtue of waves and/or speed of the tug. If a small portion passes over or under the first rope 25 it is picked up by the second rope 25, the same being true down the line. The sheet is progressively concentrated towards to median axis while crossing the thin portion of the ropes 25 adjacent to the rope 24 without difficulty.

It should be further noted that the inclined position of the wings 11*a* and 11*b* and of the ropes 25 with respect to the axis of the movement F of the device results in the cross section encountered with respect to longitudinal liquid currents f' (FIG. 4) being an elongated ellipse having a hydrodynamic shape (in the general case of cables having a circular cross section).

Thus, the floating waste are in their entirety increasingly concentrated towards the longitudinal axis and towards the rear so as to be "picked-up" by the inlet 19 of the recovery apparatus 21.

The device may likewise operate continuously if, for example, the floating element 20 is a barge which is replaced by another barge as soon as it has been filled. In effect, the lightness of the system permits extremely rapid hitching and unhitching of the barrier. It should further be noted that the barge together with the recovery apparatus are arranged in line with the tug and are, therefore, in a protected zone and, as a result, the pollution by the hydrocarbons, is in the form of an oily sheet which is "flattened" which improves recovery.

Although the invention has been described with respect to particular means, materials and methods of use, it is to be understood that the invention is not limited to the particulars disclosed but extends to cover all alternative devices falling within the scope of the claims.

What is claimed is:

1. A device for cleaning a liquid surface to remove a polluted material therefrom, said device comprising:

(a) a barrier adapted to float on the surface of said liquid, said barrier comprising two diverging wing portions and a tow portion positioned between said wing portions;

(b) inlet means adapted to receive said polluted material prior to passing said polluted material to a recovery apparatus; and (c) hitching means adapted to maintain each of said wing portions spaced from one another at one of their ends while said barrier is being towed;

each of said wing portions of said barrier comprising only a wing rope adapted to at least partially float on said liquid surface, and wherein said central portion comprises only a flexible tow rope arranged between said wing ropes, said tow rope being adapted to pull said recovery apparatus to thereby exert tension on each of said wing ropes in an amount adapted to maintain each of said wing ropes such that they do not substantially curve in a horizontal plane relative to said surface and to allow for movement of said wing ropes in a vertical plane with respect to said surface.

2. The device as defined by claim 1 wherein said inlet means is mounted on a floating element.

3. The device as defined by claim 2 wherein said hitching means is mounted on a towing means and wherein said hitching means extends transversely to the axis along which said barrier is being towed, said hitching means comprising an outer attachment point at each end of said hitching means whereby one of said wing ropes is connected to said hitching means at each outer attachment point, and an inner attachment point between each of said outer attachment points, said tow rope being attached to said inner attachment point.

4. The device as defined by claim 3 wherein said wing rope exhibits high tension resistance.

5. The device as defined by claim 4 wherein the angle separating each of said wing ropes is less than about 30 degrees.

6. The device as defined by claim 5 wherein said hitching means comprises a tubular whiffletree having a triangular configuration.

7. The device as defined by claim 6 wherein said whiffletree comprises two outwardly extending arms, each of said arms comprising a float on the outer end thereof.

8. The device as defined by claim 7 wherein said tubular whiffletree is in the form of a triangle having an apex and is journalled on a tugboat around a vertical axis at said apex.

9. The device as defined by claim 8 wherein each of said arms of said whiffletree is pivotable around a horizontal hinge whereby each of said arms may be raised and lowered in the vertical direction.

10. The device as defined by claim 9 further comprising means for raising each of said arms when not in use to facilitate maneuver of said tug.

11. The device as defined by claim 3 further comprising supplemental ropes arranged between each of said wing ropes and said tow rope, each of said supplemental ropes extending from a forward point along one of said wing ropes to a rearward point on said tow rope, said forward and rearward points being defined with respect to said tow rope when it exerts tension upon said wing ropes.

12. The device as defined by claim 11 wherein each of said supplemental ropes has a cross section substantially equal to that of said wing ropes along most of its length and wherein the cross section of said supplemental rope adjacent to said tow rope is less than the cross section over the rest of its length.

13. The device as defined by claim 12 wherein the cross section of each of said wing ropes and each of said supplemental ropes increases in the direction from said hitching means to said inlet means so as to minimize leakage of said polluted material by virtue of the increasing thickness of the layer of polluted material formed.

14. The device as defined by claim 3 wherein the cross section of each of said wing ropes increases in the direction from said hitching means to said inlet so as to minimize leakage of said polluted material by virtue of the increasing thickness of the layer of polluted material formed.

15. A device for cleaning a liquid surface to remove polluted material therefrom, said device comprising:

(a) a barrier to float on the surface of said liquid, said barrier comprising two diverging wing ropes and a tow rope positioned between said wing ropes, said tow rope adapted to pull a recovery apparatus and to thereby exert tension on each of said wing ropes in an amount sufficient to prevent said wing ropes from substantially curving along a horizontal plane relative to said surface while permitting movement of said wing ropes along a vertical plane relative to said surface, said barrier further comprising supplemental ropes positioned between each of said wing ropes and said tow rope, each of said supplemental ropes extending from a forward point along one of said wing ropes to a rearward point on said tow rope, said forward and said rearward points being defined with respect to the position of said tow rope when it exerts tension on said wing ropes, said floating barrier adapted to direct polluted material along said liquid surface by its contact with said polluted material, said contact being maintained by virtue of the barrier moving in accordance with vertical movement of said surface;

(b) inlet means mounted on a floating element and adapted to receive said polluted material prior to passing said polluted material to a recovery apparatus; and (c) hitching means adapted to maintain said wing ropes spaced from one another at one end of said wing ropes while said barrier is being towed, said hitching means being mounted on a towing means and extending generally transversely to the axis along which said barrier is being towed, said hitching means comprising an outer attachment point at each end of said hitching means, whereby one of said wing ropes is connected to said hitching means at each attachment point, and an inner attachment point between each of said outer attachment points, said tow rope being attached to said inner attachment point.

16. A device for cleaning a liquid surface to remove polluted material therefrom, said device comprising:

(a) a barrier to float on the surface of said liquid, said barrier comprising two diverging wing ropes and a tow rope positioned between said wing ropes, said tow rope adapted to pull a recovery apparatus and to thereby exert tension on each of said wing ropes in an amount sufficient to prevent said wing ropes from substantially curving along a horizontal plane relative to said surface while permitting movement of said wing ropes along a vertical plane relative to said surface, said floating barrier adapted to direct polluted material along said liquid surface by its contact with said polluted material, said contact being maintained by virtue of the barrier moving in accordance with vertical movement of said surface;

(b) inlet means mounted on a floating element and adapted to receive said polluted material prior to passing said material to a recovery apparatus; and (c) hitching means adapted to maintain said wing ropes spaced from one another at one end of said wing ropes while said barrier is being towed, said hitching means being mounted on a towing means and extending transversely to the axis along which said barrier is being towed, said hitching means comprising an outer attachment point at each end of said hitching means, whereby one of said wing ropes is connected to said hitching means at each attachment point, and an inner attachment point between each of said outer attachment points, said tow rope being attached to said inner attachment point, said wing ropes each having a cross section which increases in a direction extending from said hitching means towards said inlet to thereby minimize leakage of said polluted material from said device by virtue of increasing thickness of the layer of polluted material formed adjacent to said increasing cross section wing ropes.

* * * * *

UNITED STATES PATENT AND TRADEMARK OFFICE

CERTIFICATE OF CORRECTION

PATENT NO. : 4,294,698

DATED : October 13, 1981

INVENTOR(S) : Jean A.L. BRONNEC

It is certified that error appears in the above—identified patent and that said Letters Patent is hereby corrected as shown below:

In the Foreign Application Priority Data, "Apr. 12, 1981" should be --December 4, 1978--.

In the Abstract, line 7, "only" should be deleted; and line 11, --only-- should be inserted after "comprises".

Column 3, line 3, "the" should be omitted; and line 4, "manouver" should be --maneuver--.

In claim 12 at column 7, line 14,--either-- should be inserted before "claim" and --or claim 15-- should be inserted after "11".

Signed and Sealed this

*Twelfth* Day of *January 1982*

[SEAL]

*Attest:*

GERALD J. MOSSINGHOFF

*Attesting Officer* *Commissioner of Patents and Trademarks*